US009445654B2

(12) United States Patent
Drew et al.

(10) Patent No.: US 9,445,654 B2
(45) Date of Patent: Sep. 20, 2016

(54) CONVERTIBLE SECURITY WALLET

(71) Applicant: Target Brands, Inc., Minneapolis, MN (US)

(72) Inventors: Jason V. Drew, Minneapolis, MN (US); Slobodan S. Zivanovic, Des Plaines, IL (US)

(73) Assignee: Target Brands, Inc., Minneapolis, MN (US)

( * ) Notice: Subject to any disclaimer, the term of this patent is extended or adjusted under 35 U.S.C. 154(b) by 41 days.

(21) Appl. No.: 14/571,789

(22) Filed: Dec. 16, 2014

(65) Prior Publication Data

US 2016/0166030 A1 Jun. 16, 2016

(51) Int. Cl.

| | |
|---|---|
| ***A45C 1/04*** | (2006.01) |
| ***A45C 13/18*** | (2006.01) |
| ***A45C 1/06*** | (2006.01) |

(52) U.S. Cl.

CPC ..... *A45C 13/185* (2013.01); *A45C 1/06* (2013.01)

(58) Field of Classification Search

CPC ..... A45C 1/04; A45C 1/06; A45C 13/185
USPC ..... 150/102, 108, 112, 134; 224/578, 581; 383/4

See application file for complete search history.

(56) References Cited

U.S. PATENT DOCUMENTS

| | | | | | |
|---|---|---|---|---|---|
| 1,972,480 | A * | 9/1934 | Gomi | A45C 1/04 | 224/222 |
| 3,322,311 | A | 5/1967 | Homer | | |
| 4,545,414 | A | 10/1985 | Baum | | |
| 4,570,688 | A | 2/1986 | Williams | | |
| 4,815,510 | A | 3/1989 | Edelist | | |
| 4,887,751 | A * | 12/1989 | Lehman | A45C 5/14 | 190/1 |
| 4,905,881 | A * | 3/1990 | Graber | A45C 1/04 | 150/131 |
| 4,998,653 | A | 3/1991 | LaBelle | | |
| 5,285,833 | A | 2/1994 | Haxby | | |
| 5,318,084 | A * | 6/1994 | Jackson | A45C 13/30 | 150/102 |
| 6,209,769 | B1 * | 4/2001 | Seals | A45C 1/04 | 224/583 |
| 6,648,196 | B2 * | 11/2003 | Morrison | A45F 3/047 | 224/197 |
| 7,160,028 | B1 * | 1/2007 | Linday | A45C 9/00 | 150/108 |
| 8,028,879 | B2 * | 10/2011 | Amishay | A45F 3/02 | 224/578 |
| 8,746,523 | B1 * | 6/2014 | Woolley | A45C 13/30 | 224/578 |
| 2001/0027834 | A1 * | 10/2001 | Southwick | A45C 3/00 | 150/108 |

FOREIGN PATENT DOCUMENTS

FR 2510879 A1 * 2/1983

OTHER PUBLICATIONS

Total Travel Source, "Security Body Pouch Wallet-D.BE / Hidden safe Travel Pouch," http://store.totaltravelsource.com/store/security-body-pouch-wallet-d-be-hidden-safe-travel-pouch/, at least as early as Sep. 2014, 1 page.

* cited by examiner

*Primary Examiner* — Sue A Weaver
(74) *Attorney, Agent, or Firm* — Leanne Taveggia Farrell; Westman, Champlin & Koehler, P.A.

(57) ABSTRACT

A security wallet includes a pouch and a strap. The pouch has at least one pocket with a closeable opening. The strap has a fixed end that is directly attached to the pouch and a detachable end that is removably coupled to the pouch. The strap extends from the fixed end and outwardly from a first side of the pouch. In a first configuration, the detachable end is coupled to the first side of the pouch. In a second configuration, the detachable end is coupled to a second side of the pouch opposite the first side.

16 Claims, 15 Drawing Sheets

CONVERTIBLE SECURITY WALLET

BACKGROUND

Undercover wallets and money belts are worn underneath a person's clothing so as to protect valuables from thieves or pickpockets. The undercover wallets or money belts include a pocket that is often closed with a zipper, but can be closed with other types of fasteners including hook and loop material. These types of wallets are usually worn by tourists to carry such things as passports, travel tickets, identification cards, credit cards, cash, jewelry and etc. Undercover wallets can include a drawstring for hanging from around a person's neck or for being tightened to fit around the waist. Money belts include straps that buckle around a person's waist.

The discussion above is merely provided for general background information and is not intended to be used as an aid in determining the scope of the claimed subject matter.

SUMMARY

A security wallet includes an item holder and an adjustable strap. The item holder has a front surface, a back surface, opposing first and second ends and opposing first and second sides. The adjustable strap has a fixed end that is attached to the item holder in close proximity to where the first end and the first side of the item holder intersect and a detachable end having a fastener component. The fixed end of the adjustable strap is attached to the item holder such that the adjustable strap extends outwardly from the first end of the item holder. The security wallet also includes a first mating component that is attached to the item holder in close proximity to where the first end and the second side intersect. The first mating component extends outwardly from the first end of the pouch. The security wallet also includes a second mating component that is attached to the item holder in close proximity to where the second end and the first side intersect. The second mating component extends outwardly from the second end of the pouch.

A security wallet includes a pouch having multiple layers of fabric sewed together to form a pouch thickness and includes a front layer, a back layer and at least one mid layer. The pouch has four sides that form four corners. The security wallet also includes a strap having a proximal end with a fastener component. The proximal end of the strap is directly attached to the pouch so that the strap extends from a first side of the pouch and the fastener on the distal end of the strap is removably coupled to one of a first mating component that extends from the first side of the pouch and a second mating component that extends from a third side of the pouch that is opposite the first side of the pouch.

A security wallet includes a pouch and a strap. The pouch has at least one pocket with a closeable opening. The strap has a fixed end that is directly attached to the pouch and a detachable end that is removably coupled to the pouch. The strap extends from the fixed end and outwardly from a first side of the pouch. In a first configuration, the detachable end is coupled to the first side of the pouch. In a second configuration, the detachable end is coupled to a second side of the pouch opposite the first side.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Described below is a security wallet that can converted to be worn in two different positions or configurations. In the first configuration, the security wallet can be worn so that it comfortably hangs from around a person's neck. In the second configuration, the security wallet can be worn comfortably around the person's torso in a money belt type configuration. These alternate positions are made possible by including a strap that is stitched to the security wallet and including a component of a fastener at an opposite end of the strap. Further, the security wallet includes two mating components that engage with the component at the end of the strap. One of the mating components is located on the same side of the security wallet where the strap is stitched to the security wallet. The other of the mating components is located on an opposite side of the security wallet from where the strap is stitched to the security wallet.

Figure 1:
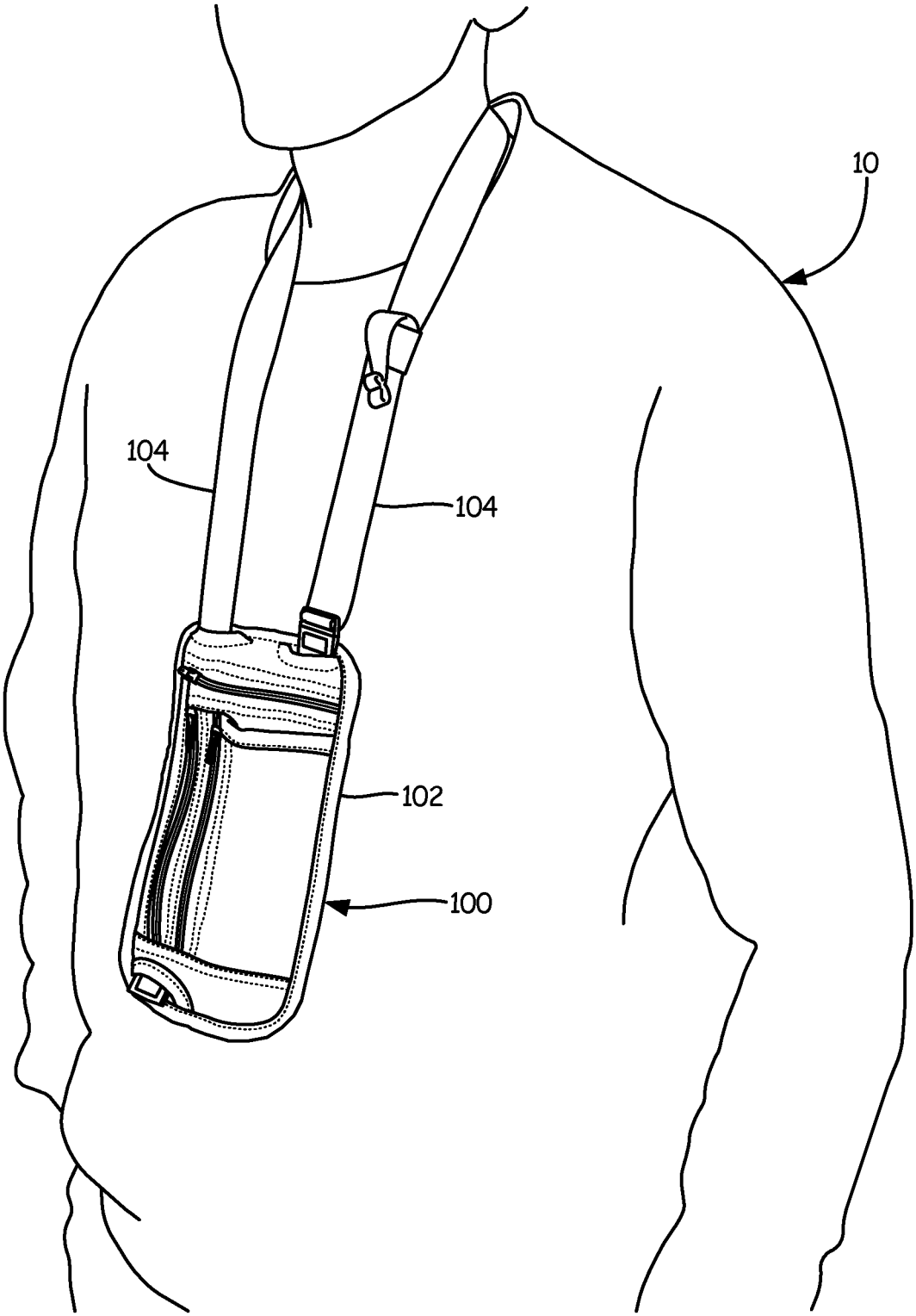
FIG. 1 illustrates a person carrying a security wallet in a first configuration in accordance with one embodiment.
Figure 2:
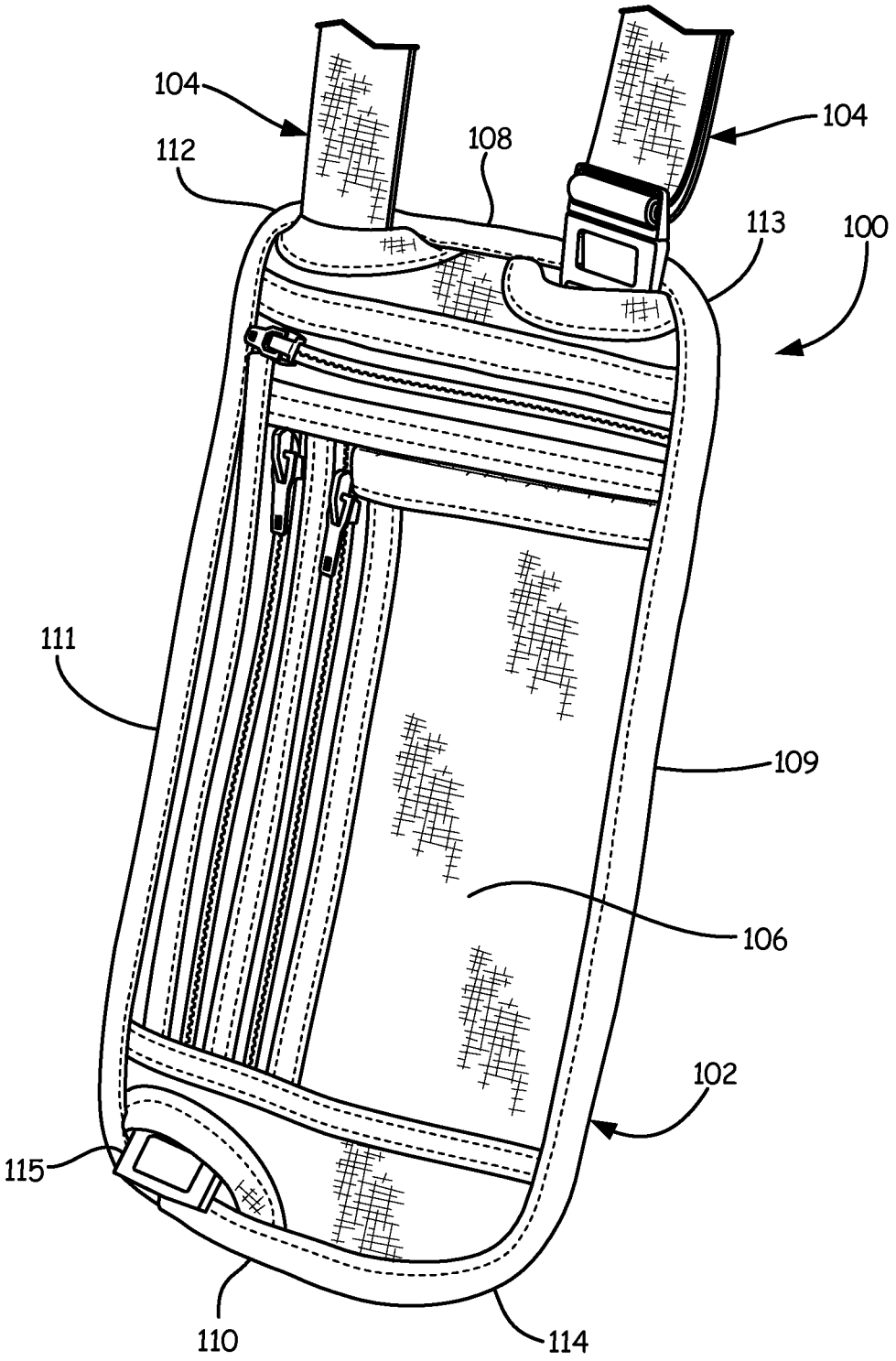
FIG. 2 is a perspective view of the security wallet shown in FIG. 1 with a portion of the straps not shown for convenience of illustration.

FIG. 1 illustrates a user 10 carrying a convertible security wallet 100 in accordance with a first configuration and in accordance with one embodiment. FIG. 2 is a perspective view of security wallet 100 shown in FIG. 1 with a portion of the straps not shown for convenience of illustration.

FIGS. 3-8 are respective front, back, top, bottom, left side and right side views of security wallet 100 of FIG. 2.

Security wallet 100 includes an item holder or pouch 102 and an adjustable strap 104. Item holder or pouch 102 includes multiple layers of fabric sewed together to form a pouch thickness 103. Item holder 102 includes a front surface 106, a back surface 107 and four sides 108, 109, 110 and 111 that form four corners 112, 113, 114 and 115. Sides 108 and 110 are opposite each other and sides 109 and 111 are opposite each other. Side 108 intersects with side 109 to provide corner 113. Side 109 intersects with side 110 to provide corner 114. Side 110 intersects with side 111 to provide corner 115 and side 111 intersects with side 108 to provide corner 112. Therefore, corners 112 and 115 are in alignment with each other along side 111 and corners 113 and 114 are in alignment with each other along side 109. The four sides 108-111 are also referred to as opposing first and second ends 108 and 110 and opposing first and second sides 109 and 111.

In one embodiment, strap 104 is made of an elastic material. However, other materials are possible including non-elastic materials such as webbing, cording, leather and etc. Strap 104 includes a fixed end or proximal end 116 (illustrated in phantom lines in FIG. 3) and a detachable end or distal end 118. Fixed end 116 is directly attached to pouch 102 in closer proximity to corner 112 than to corner 113. Fixed end 116 of strap 104 is directly attached to pouch 102 such that strap 104 extends outwardly from side 108 of pouch 102. Detachable end 118 of strap 104 is removably attached to pouch 102 and includes a fastener component 120. For example, fastener component 120 can be a male fastener component.

Security wallet 100 further includes a first mating component 122 and a second mating component 124 for engaging with fastener component 120. For example, first mating component 122 can be a female receiver component and second mating component 124 can be a female receiver component. First mating component 122 is attached to pouch 102 in closer proximity to corner 113 than to corner 112. In addition, first mating component 122 extends from side 108 of pouch 102. Second mating component 124 is attached to pouch 102 in closer proximity to corner 115 than to corner 114. In addition, second mating component 124 extends from side 110 of pouch 102.

Fastener component 120 located on detachable end 118 of strap 104 is removably coupled to first mating component 122 in a first configuration and to second mating component 124 in a second configuration. Accordingly, the orientation of item holder or pouch 102 in the second configuration is different from the first configuration. In the first configuration illustrated in FIGS. 1-12, side 108 is oriented at a top, opposing side 110 is oriented at a bottom and fastener component 120 is engaged with first mating component 122 such that detachable end 118 of strap 104 is positioned along side 108 of item holder 102 or otherwise coupled to side 108 of item holder 102. In the first configuration, where fastener component 120 is engaged with first mating component 122, item holder 102 can be allowed or configured to hang from a neck of user 10 as is illustrated in FIG. 1 and be adjusted to how far down the user wants pouch 102 to hang. In addition, in the first configuration, item holder 102 can also be allowed or configured to be secured around a user's torso. However, wearing pouch 102 in the first configuration around the torso may not be as comfortable as wearing pouch 102 in the second configuration around the torso.

Figure 3:
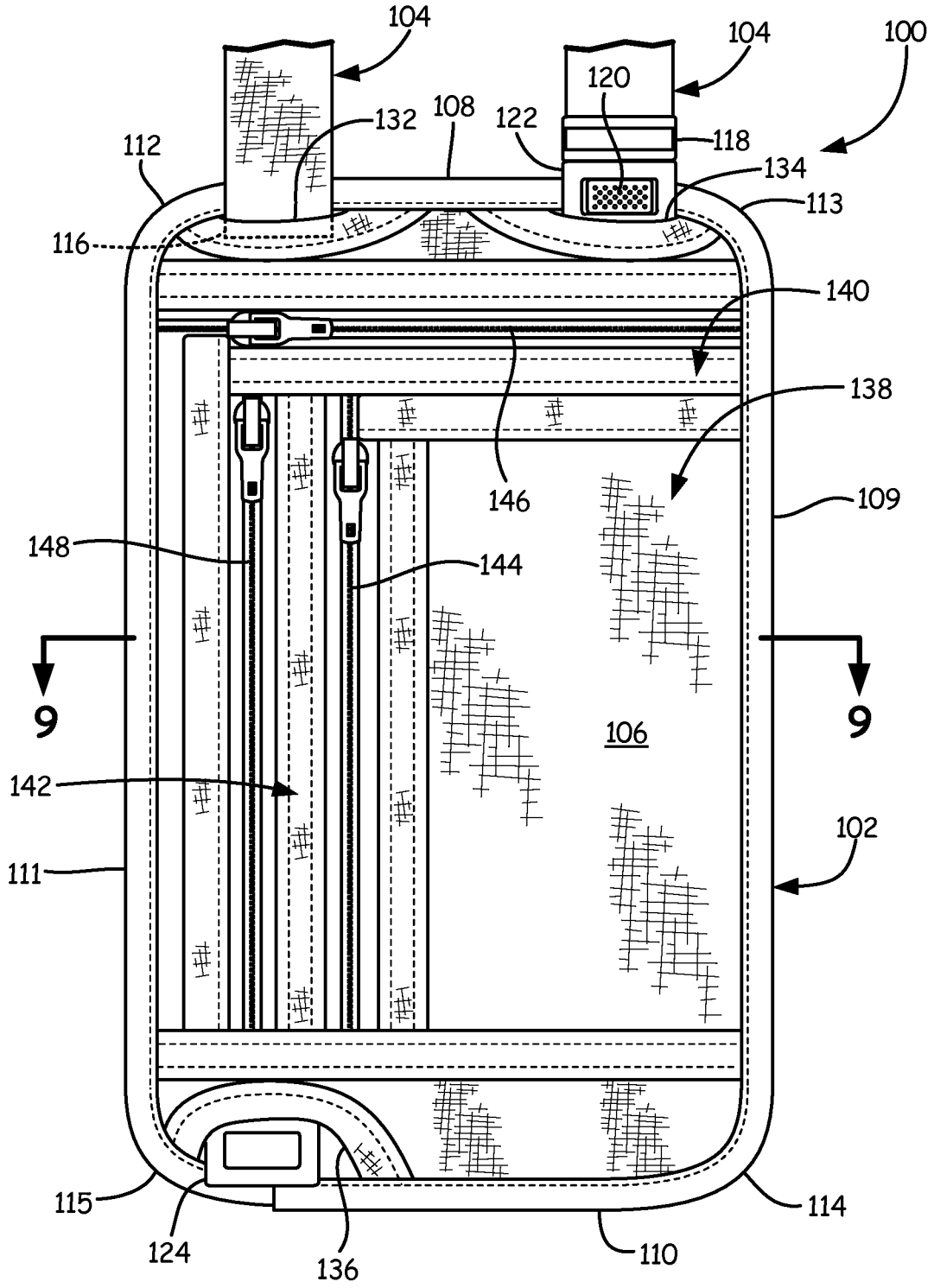
FIG. 3 is a front view of the security wallet of FIG. 2.
Figure 4:
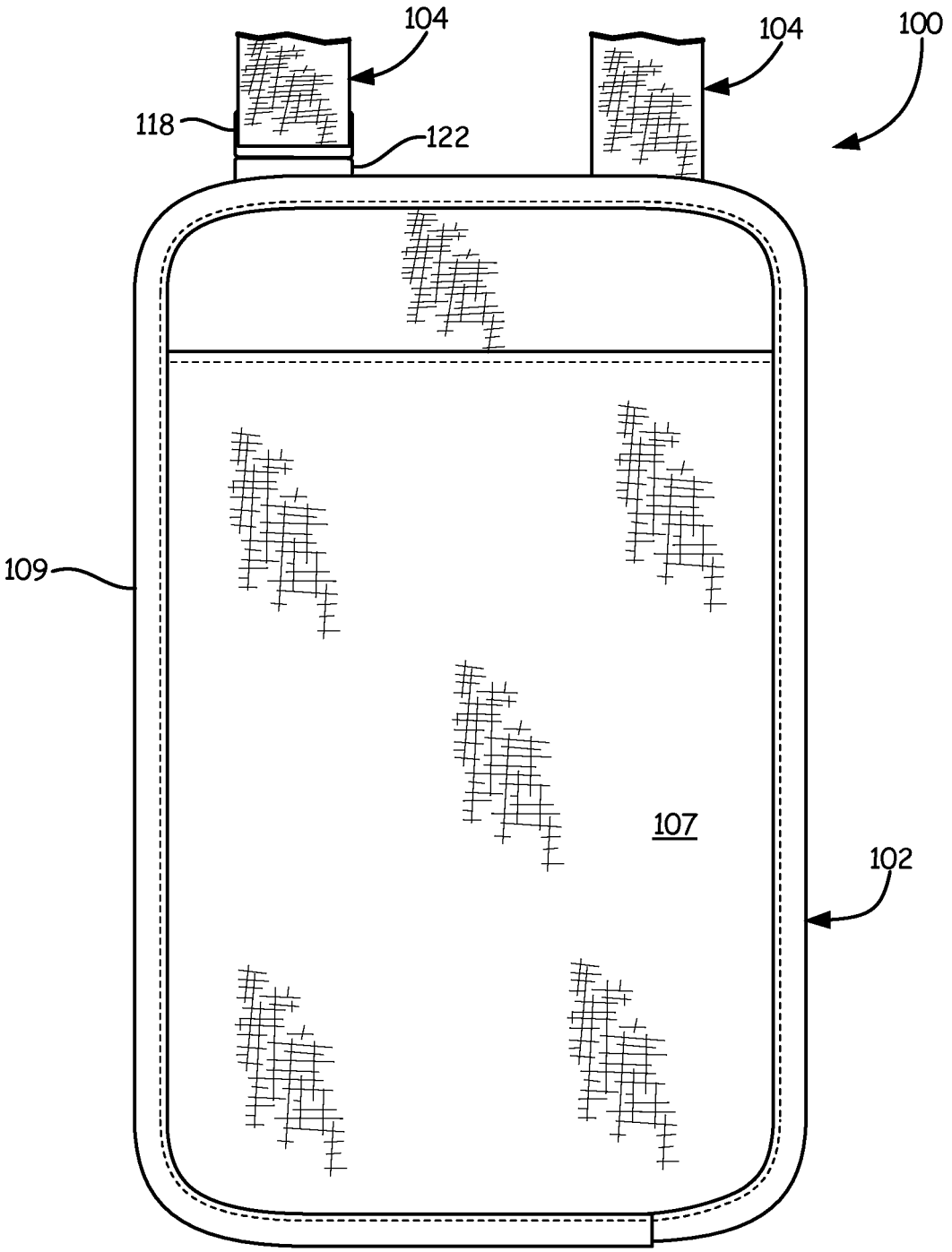
FIG. 4 is a back view of the security wallet of FIG. 2.
Figure 5:
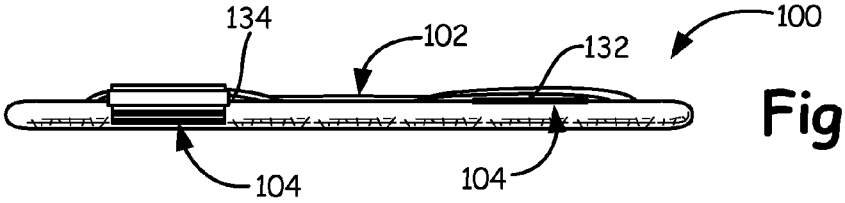
FIG. 5 is a top view of the security wallet of FIG. 2.
Figure 6:
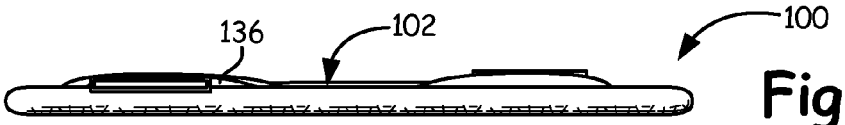
FIG. 6 is a bottom view of the security wallet of FIG. 2.
Figure 7:
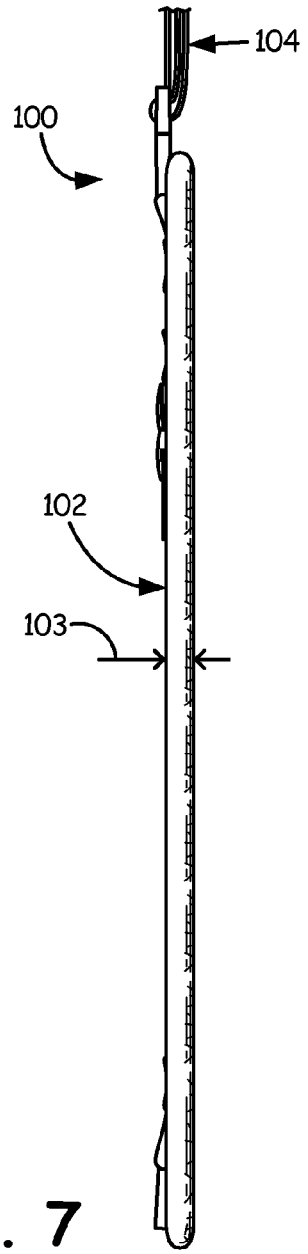
FIG. 7 is a left side view of the security wallet of FIG. 2.
Figure 8:
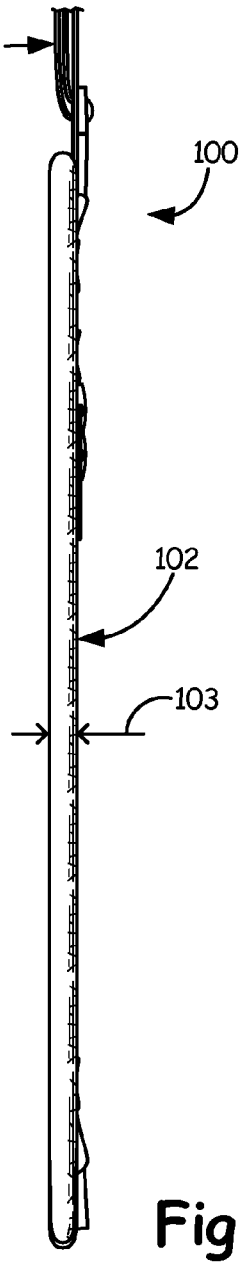
FIG. 8 is a right side view of the security wallet of FIG. 2.
Figures 9, 10:
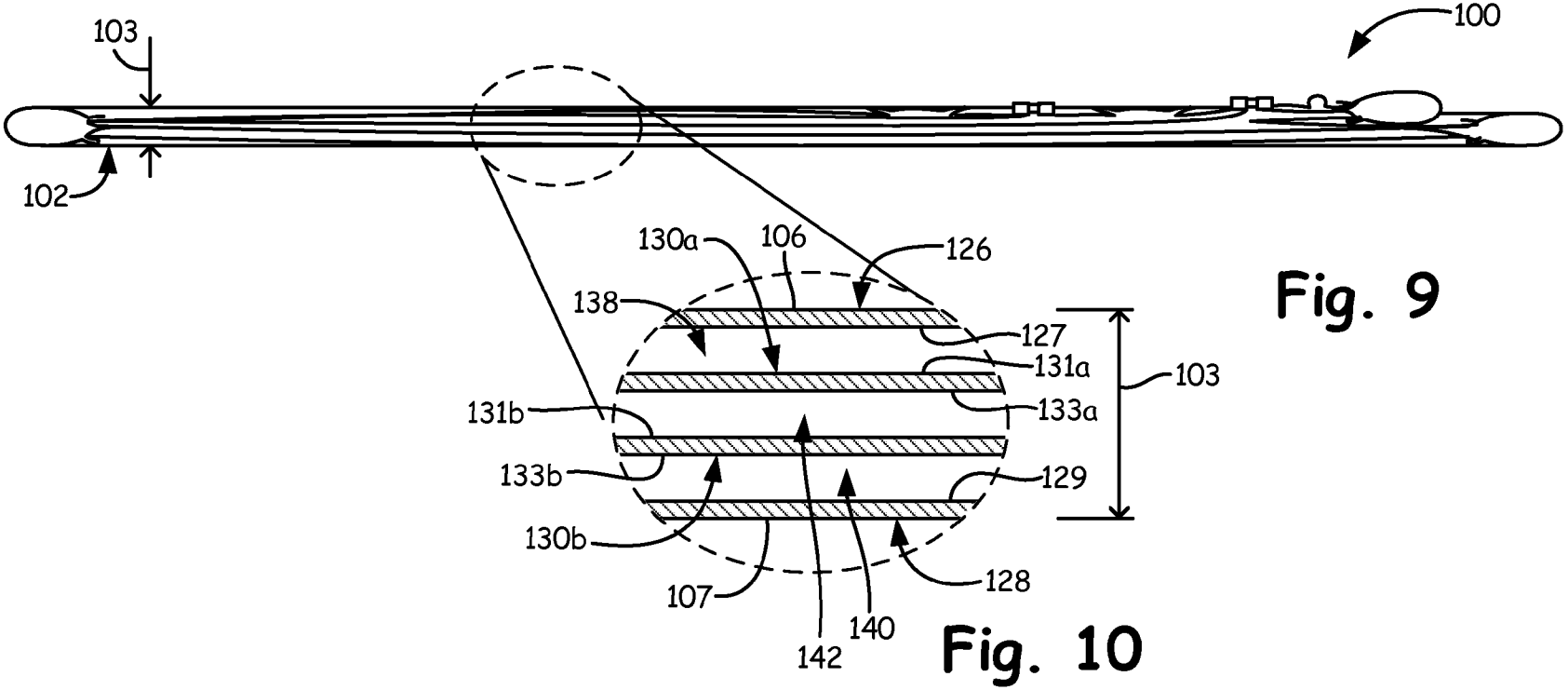
FIG. 9 is a section view of the security wallet of FIG. 2 taken through the line indicated in FIG. 3.
FIG. 10 is an enlarged view of a portion of the section view of FIG. 9.

FIG. 9 is a section view of security wallet 100 taken through the line indicated in FIG. 3 and FIG. 10 is an enlarged view of a portion of the section view of FIG. 9. As illustrated, the multiple layers of fabric of security wallet 100 include a front layer 126, a back layer 128 and at least one mid layer. In the embodiment illustrated, security wallet 100 includes a first mid layer 130*a* and a second mid layer 130*b*. Front layer 126 includes front or exterior surface 106 and an inner surface 127. Back layer 128 includes a back or exterior surface 107 and an inner surface 129. Mid layer 130*a* includes opposing inner surfaces 131*a* and 133*a* and mid layer 130*b* includes opposing inner surface 131*b* and 133*b*.

The front layer 126 of item holder 102 provides three openings in item holder or pouch 102. First opening 132 houses proximal end 116 of strap 104, second opening 134 houses first mating component 122 and third opening 136 houses second mating component 124. Proximal end 116 of strap 104, first mating component 122 and second mating component 124 are each attached to an inner surface of one of the layers of fabric (for example, inner surface 127 of front layer 126, inner surface 129 of back layer 128, or one of inner surfaces 131*a*, 131*b*, 133*a* or 133*b* of mid layers 130*a* and 130*b*) and extend through respective first, second and third openings 132, 134 and 136. First opening 132 in front layer 126 is located at side 108 of item holder 102 and in closer proximity to first corner 112 of item holder 102 than second corner 113 of item holder 102. Second opening 134 in front layer 126 is located at side 108 of item holder 102 and in closer proximity to second corner 113 of item holder 102 than first corner 112 of item holder 102. Third opening 136 in front layer 126 is located at side 110 of item holder 102 and in closer proximity to fourth corner 115 of item holder 102 than third corner 114 of item holder 102.

Item holder or pouch 102 further includes a plurality of pockets. In one embodiment and as best illustrated in FIG. 3, item holder 102 includes a front pocket 138, a back pocket 140 and a middle pocket 142 located between front pocket 138 and back pocket 140. Each of pockets 138, 140 and 142 include closeable openings that are closeable with respective zippers 144, 146 and 148. In particular and as illustrated in FIG. 3, zipper 144, which closes and defines the opening of front pocket 138, extends substantially parallel to sides 109 and 111 and substantially perpendicular to sides 108 and 110 when zipped. Further, zipper 146, which closes and defines the opening of back pocket 140, extends substantially parallel to sides 108 and 110 and substantially perpendicular to sides 109 and 111 when zipped. Still further, zipper 148, which closes and defines the opening of middle pocket 142, extends substantially parallel to sides 109 and 111 and substantially perpendicular to sides 108 and 110.

In the first configuration when side 108 of item holder or pouch 102 is oriented as the top and opposing side 110 is oriented as the bottom, zipper 144, which closes and defines the opening of front packet 138, is substantially vertically oriented. Further, zipper 146, which closes and defines the opening of back pocket 140, is substantially horizontally oriented. Still further, zipper 148, which closes ad defines the opening of middle pocket 142, is substantially vertically oriented.

Figure 11:
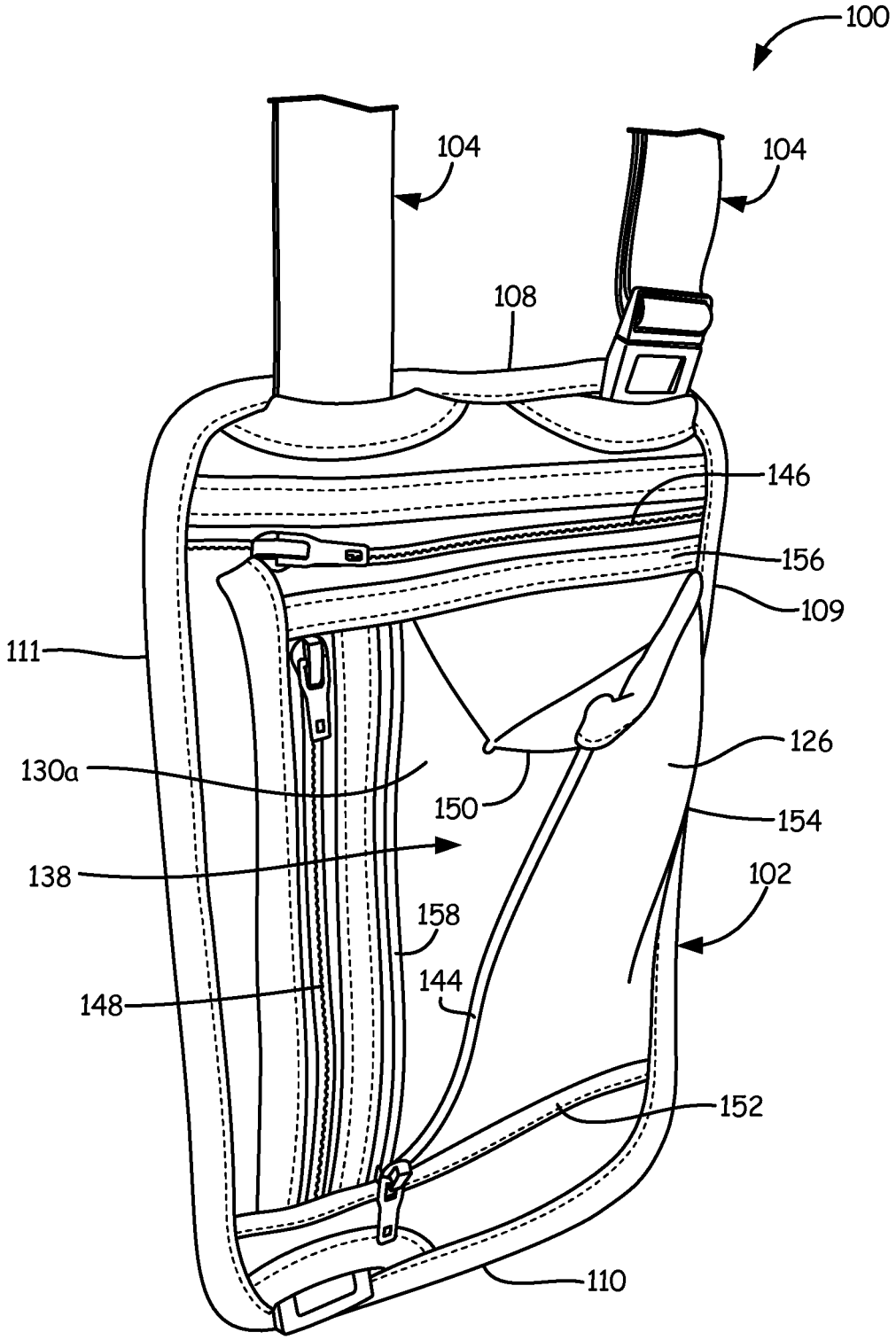
FIG. 11 is a perspective view of the security wallet of FIG. 2 with a front pocket unzipped.
Figure 12:
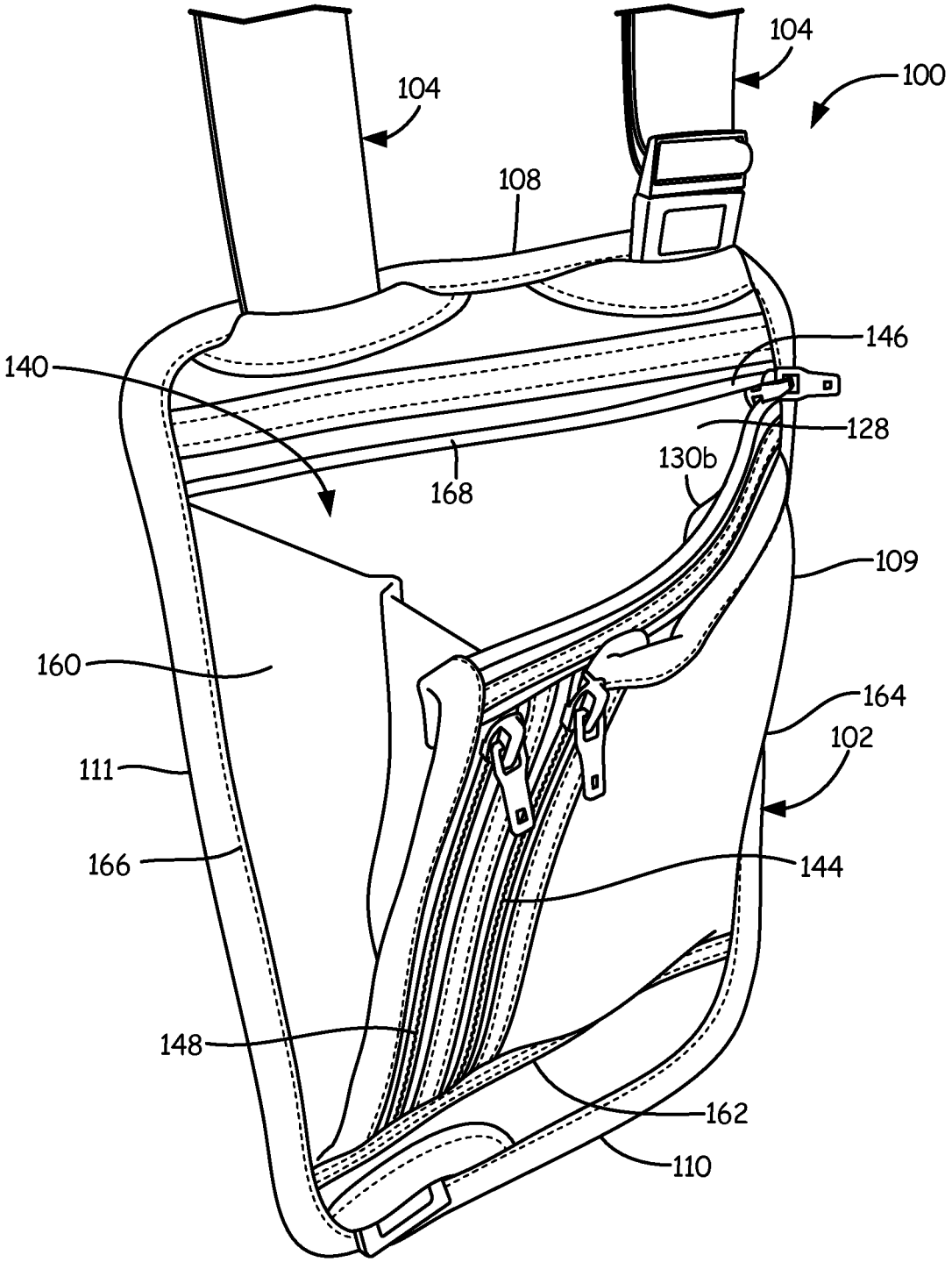
FIG. 12 is a perspective view of the security wallet of FIG. 2 with back pocket unzipped.

FIG. 11 is a perspective view of security wallet 100 in the first configuration with front pocket 138 unzipped and back pocket 140 and middle pocket 142 zipped. FIG. 12 is a perspective view of security wallet 100 with back pocket 140 unzipped and front pocket 138 and middle pocket 142 zipped. As illustrated in FIG. 11, front pocket 138 is defined by front layer 126 and mid layer 130*a* and includes a gusset 150. Front layer 126 is directly stitched to mid layer 130*a* at a first side 152 and a second side 154, but front layer 126 is connected to mid layer 130*a* by gusset 150 at a third side 156. Gusset 150 allows a user better access to items that are inside front pocket 138. A fourth side 158 of front pocket 138 is closeable by zipper 144. In the first configuration as illustrated in FIG. 11, items are kept from falling out of the sides of front pocket 138 when the opening is unzipped because of front layer 126 being directly stitched to mid layer 130*a* at first side 152.

As illustrated in FIG. 12, back pocket 140 is defined by back layer 128 and mid layer 130*b* and includes a gusset 160. Back layer 128 is directly stitched to mid layer 130*b* at a first side 162 and a second side 164, but back layer 128 is connected to mid layer 130*b* by gusset 160 at a third side 166. In the first configuration, gusset 160 allows a user a better view and access to items located inside back pocket 140. A fourth side 168 of back pocket 140 is closeable by zipper 146. As such, items are kept from falling out of the sides of back pocket 140, in the first configuration, when the opening is unzipped because of back layer 128 being directly stitched to mid layer 130*b* at second end 164 and because of the presence of gusset 160.

Middle pocket 142 is defined by mid layers 130*a* and 130*b*. Mid layer 130*a* is directly stitched to mid layer 130*b* on three sides and a fourth side of middle pocket 142 is closeable by zipper 146. In the first configuration as illustrated in FIGS. 10 and 11, items are kept from falling out of middle pocket 142 when the opening is unzipped because of mid layers 130*a* and 130*b* being directly stitched together on the three sides (i.e., the upper, right side and bottom).

Figure 13:
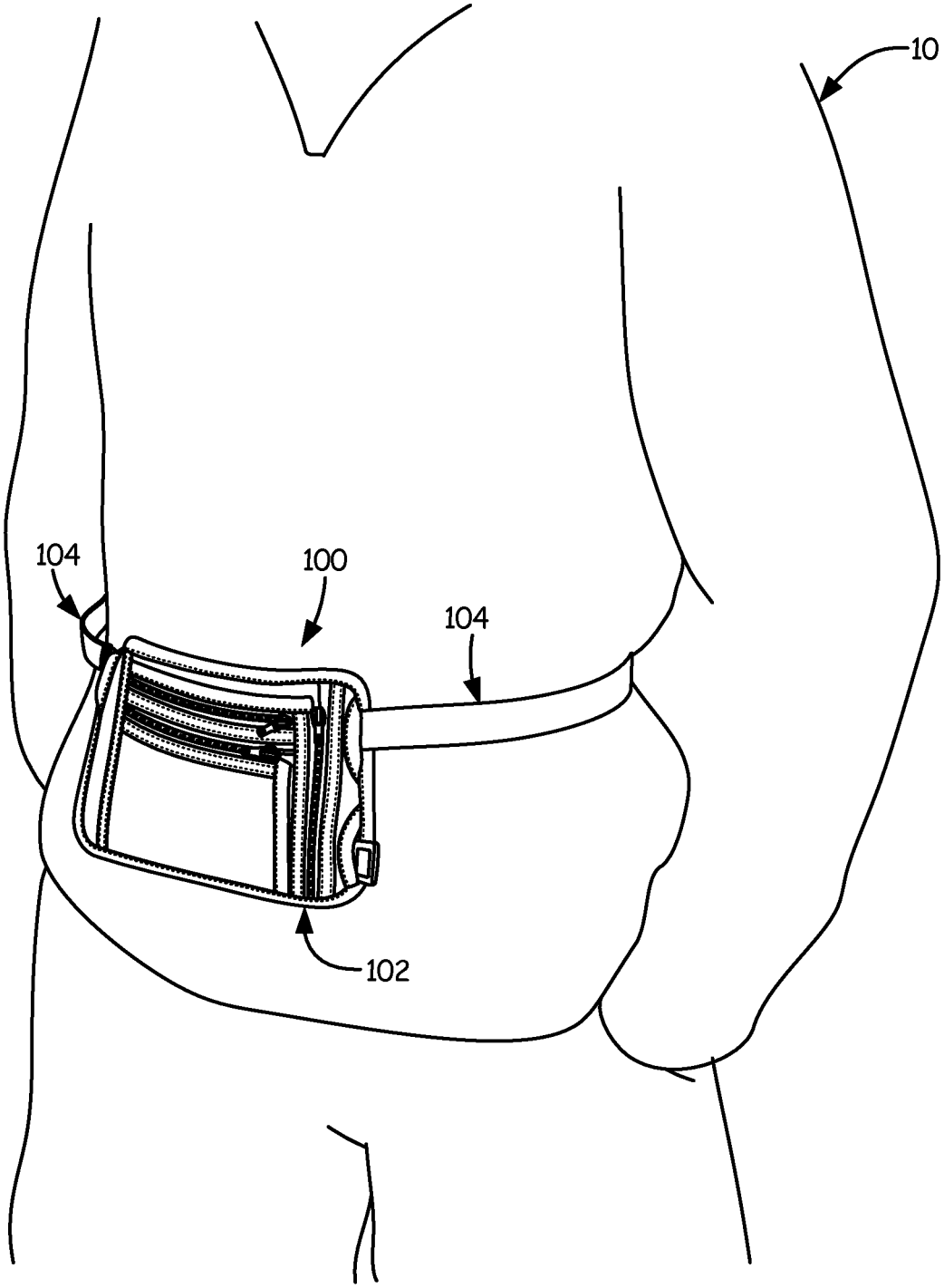
FIG. 13 illustrates a person carrying the security wallet of FIG. 1 in an alternative position or second configuration in accordance with another embodiment.

Security wallet 100 is convertible into the second configuration as illustrated in FIGS. 13-22. In the second configuration, side 111 is oriented at a top, opposing side 109 is oriented at a bottom and fastener component 120 is engaged with second mating component 124 such that detachable end 118 of strap 104 is positioned along side 110 of item holder 102 or otherwise coupled to side 110 of item holder 102. When fastener component 120 is engaged with second mating component 124 in the second configuration, item holder 102 is oriented 90 degrees clockwise from the position of the first configuration, which allows item holder or pouch 102 to be secured comfortably around a torso of user 10, such as secured around the user's waist as is illustrated in FIG. 13, by strap 104. It is possible for item holder 102 in the second configuration to also be hung around the user's neck via strap 104. However, wearing pouch 102 in the second configuration from around the neck may not be as comfortable as wearing pouch 102 in the second configuration around the torso.

Figure 14:
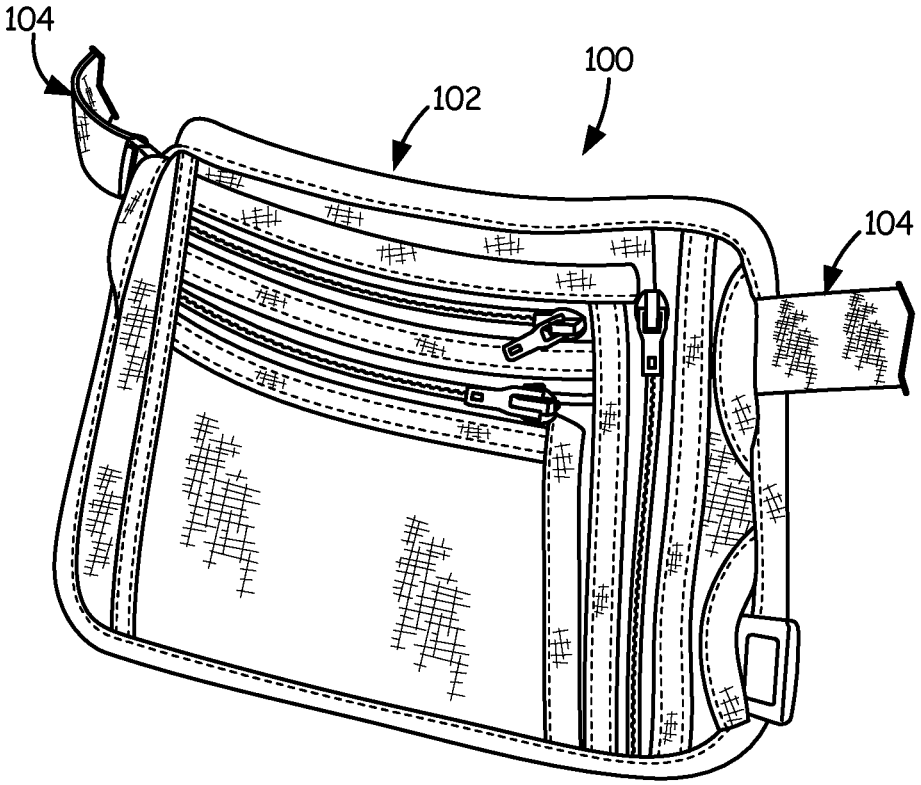
FIG. 14 is a perspective view of the security wallet shown in FIG. 13 with a portion of the straps not shown for convenience of illustration.
Figure 15:
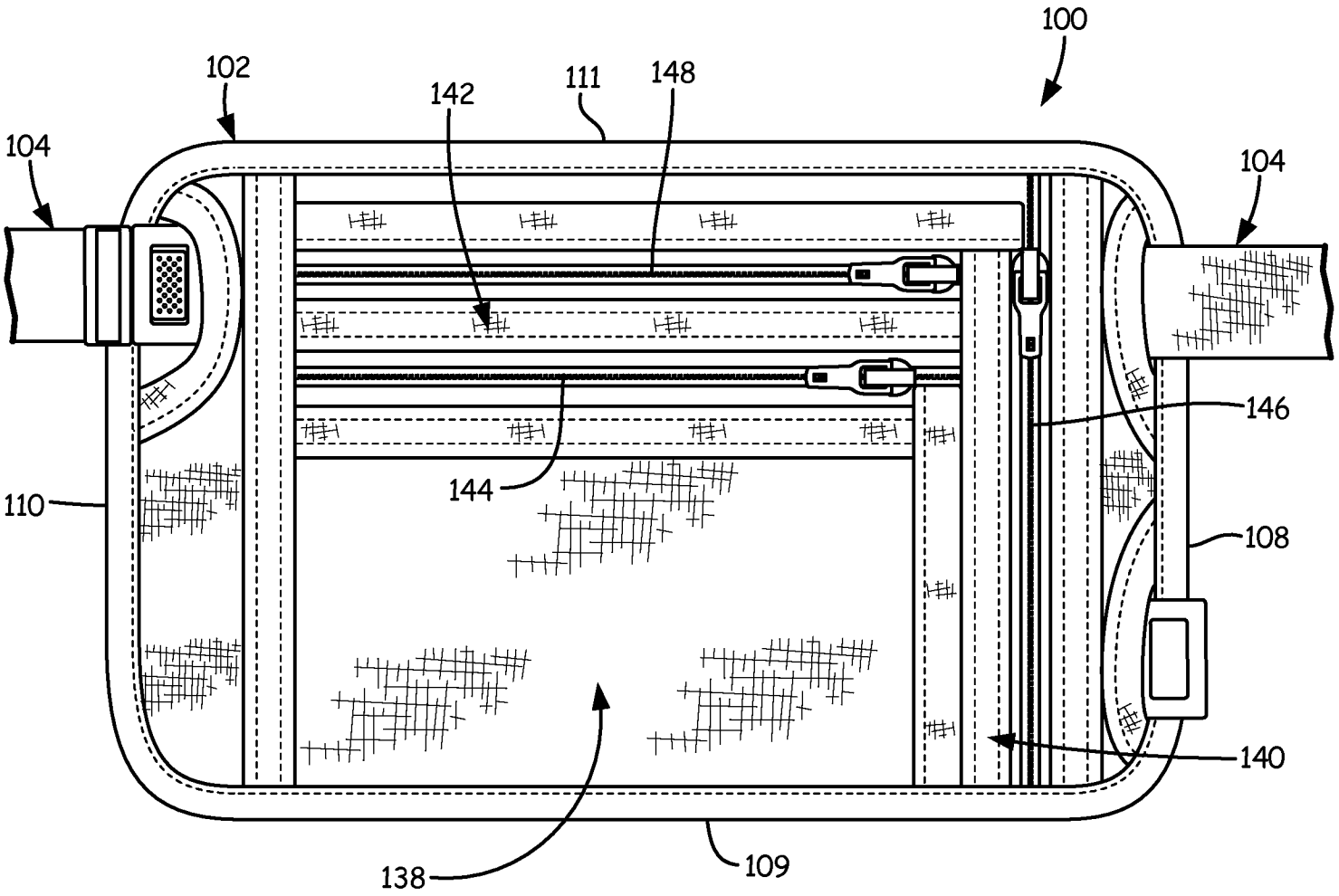
FIG. 15 is a front view of the security wallet of FIG. 14.
Figure 16:
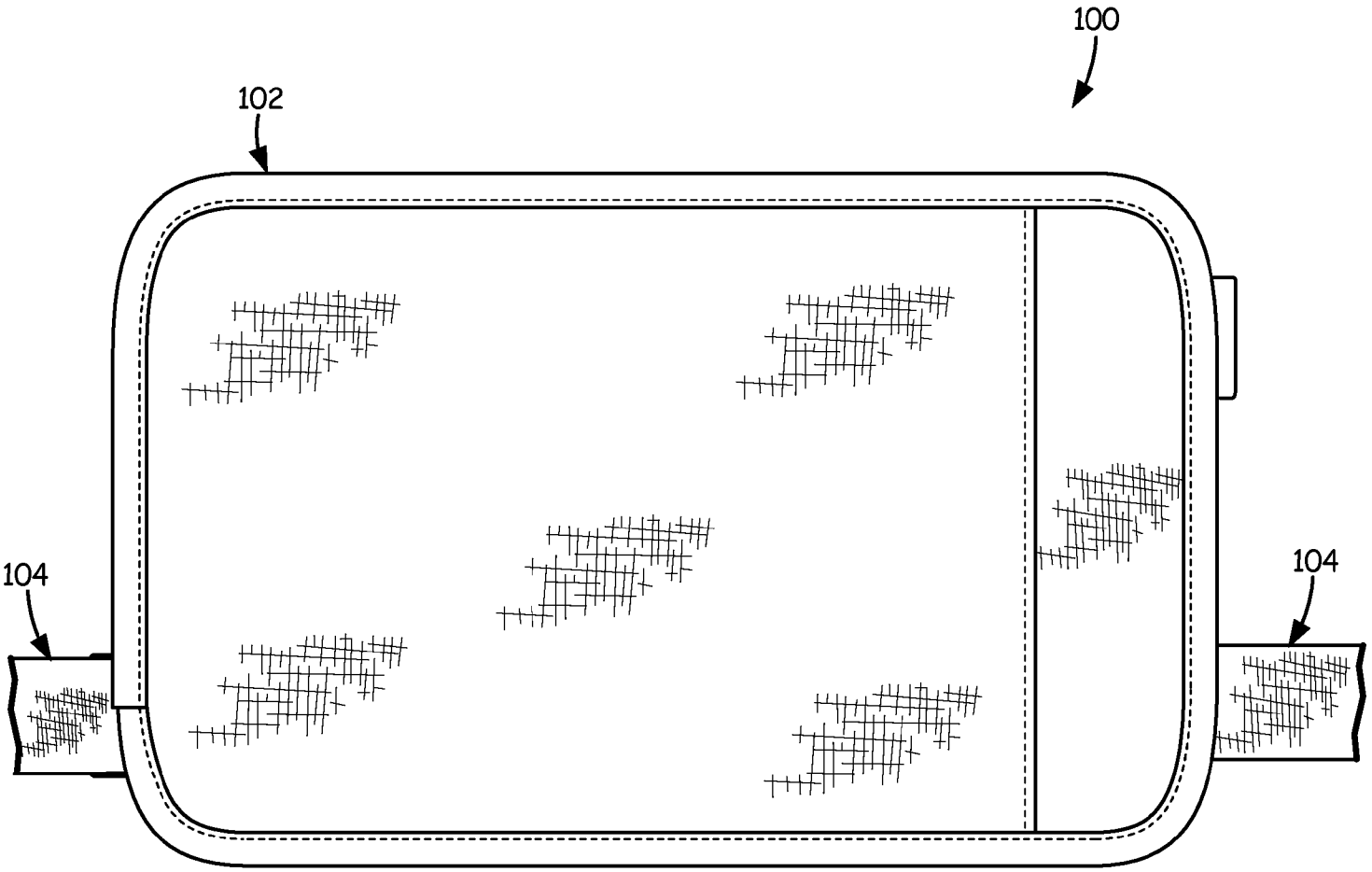
FIG. 16 is a back view of the security wallet of FIG. 14.
Figure 17:
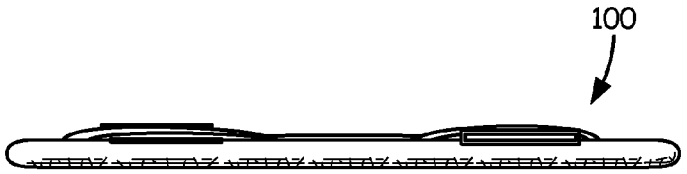
FIG. 17 is a top view of the security wallet of FIG. 14.
Figure 18:
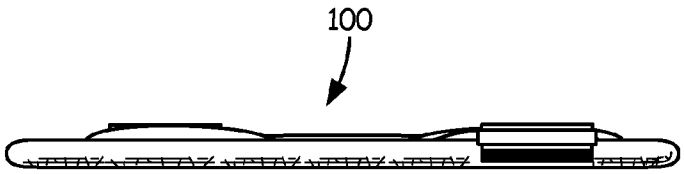
FIG. 18 is a bottom view of the security wallet of FIG. 14.
Figure 19:
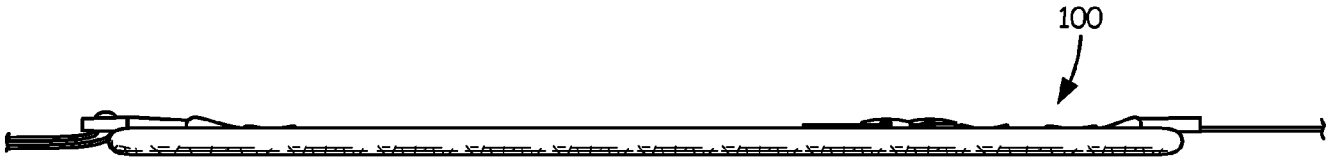
FIG. 19 is a right side view of the security wallet of FIG. 14.
Figure 20:
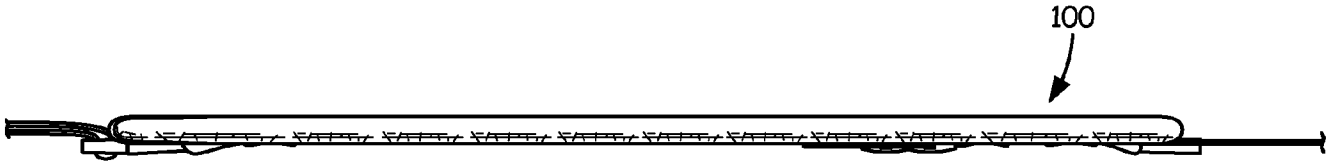
FIG. 20 is a left side view of the security wallet of FIG. 14.

FIG. 13 illustrates user 10 carrying convertible security wallet 100 around their waist in accordance with the second configuration and in accordance with another embodiment. FIG. 14 is a perspective view of security wallet 100 shown in FIG. 13 with a portion of the straps not shown for convenience of illustration. FIGS. 15-20 are respective front, back, right side, left side, top and bottom views of security wallet 100 of FIG. 14.

As previously described, item holder or pouch 102 includes a plurality of pockets including front pocket 138, back pocket 140 and middle pocket 142 located between front pocket 138 and back pocket 140. Each of pockets 138, 140 and 142 includes closeable openings that are closeable with respective zippers 144, 146 and 148. In the second configuration when side 111 of item holder or pouch 102 is oriented at the top and opposing side 109 of item holder or ouch 102 is at the bottom, zipper 144, which closes and defines the opening of front packet 138, is substantially horizontally oriented. Further, zipper 146, which closes and defines the opening of back pocket 140 is substantially vertically oriented. Still further, zipper 148, which closes and defines the opening of middle pocket 142 is substantially horizontally oriented.

Figure 21:
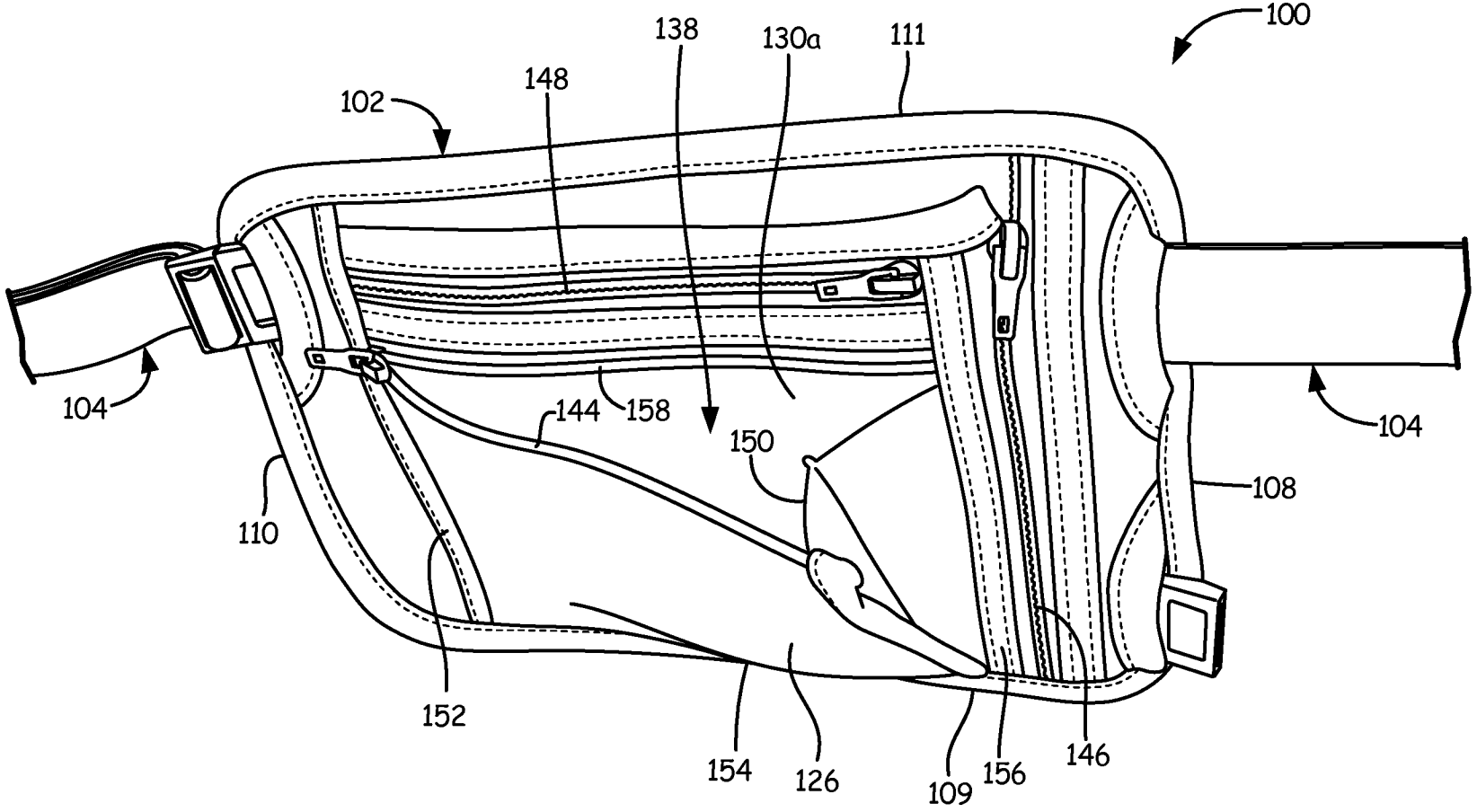
FIG. 21 is a perspective view of the security wallet of FIG. 14 with front pocket unzipped.
Figure 22:
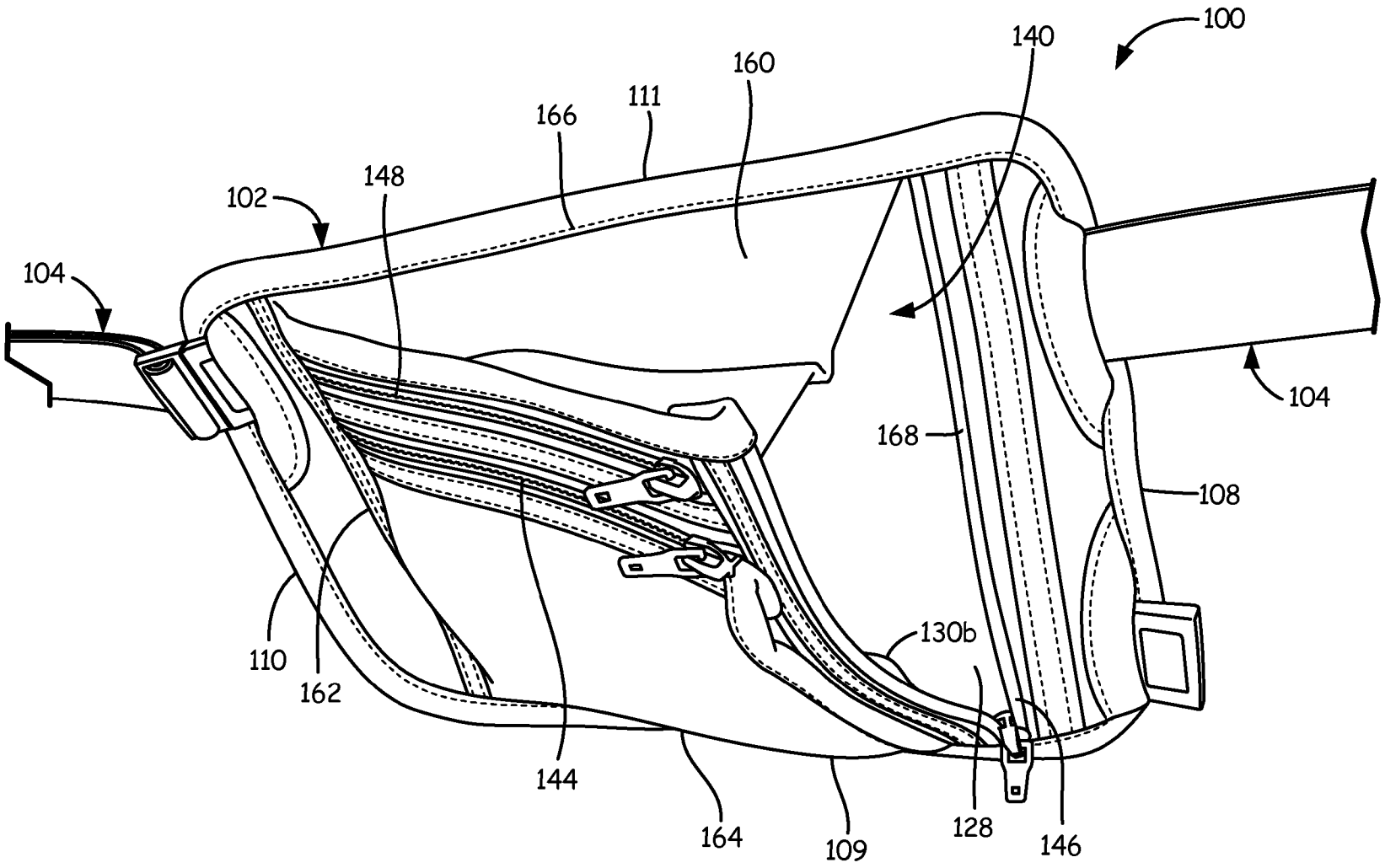
FIG. 22 is a perspective view of the security wallet of FIG. 14 with a back pocket unzipped.

FIG. 21 is a perspective view of security wallet 100 in the second configuration with front pocket 138 unzipped and back pocket 140 and middle pocket 142 zipped and FIG. 22 is a perspective view of security wallet 100 with back pocket 140 unzipped and front pocket 138 and middle pocket 142 zipped. As illustrated in FIG. 21, front pocket 138 is defined by front layer 126 and mid layer 130*a* and includes a gusset 150. Front layer 126 is directly stitched to mid layer 130*a* at a first side 152 and a second side 154, but front layer 126 is connected to mid layer 130*a* by gusset 150 at a third side 156. Gusset 150 allows a user to better view of and access to items inside front pocket 138. A fourth side 158 of front pocket 138 is closeable by zipper 144. As such, items are kept from falling out of the sides of front pocket 138, in the second configuration, when the opening is unzipped because of front layer 126 being directly stitched to mid layer 130*a* at first side 152 and because of the presence of gusset 160.

As illustrated in FIG. 22, back pocket 140 is defined by back layer 128 and mid layer 130*b* and includes a gusset 160. Back layer 128 is directly stitched to mid layer 130*b* at a first side 162 and a second side 164, but back layer 128 is connected to mid layer 130*b* by gusset 160 at a third side 166. Gusset 160 allows a user better access to items are inside back pocket 140. A fourth side 168 of back pocket 140 is closeable by zipper 146. In the second configuration as illustrated in FIG. 22, items are kept from falling out of the sides of back pocket 140 when the opening is unzipped because of back layer 128 being directly stitched to mid layer 130*b* at second end 164.

Middle pocket 142 is defined by mid layers 130*a* and 130*b*. Mid layer 130*a* is directly stitched to mid layer 130*b* on three sides and a fourth side of middle pocket 142 is closeable by zipper 146. In the second configuration as illustrated in FIGS. 21 and 22, items are kept from falling out of middle pocket 142 when the opening is unzipped because of mid layers 130*a* and 130*b* being directly stitched together on the three sides.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A security wallet comprising:

an item holder including a front, a back, and an enclosed perimeter having opposing first and second ends and opposing first and second sides, wherein the front includes at least one pocket having a closeable opening and the back being free of pockets;

a single adjustable strap including a fixed end that is attached to the item holder in close proximity to where the first end and the first side of the item holder intersect and a detachable end having a fastener component, wherein the fixed end of the adjustable strap is attached to the item holder such that the adjustable strap extends outwardly from the first end of the item holder;

a first mating component that is attached to the item holder in close proximity to where the first end and the second side intersect, the first mating component extending outwardly from the first end of the pouch and when the detachable end of the single strap is engaged with the first mating component in a first configuration at least a portion of the single strap encircles a user's neck; and a second mating component that is attached to the item holder in close proximity to where the second end and the first side intersect, the second mating component extending outwardly from the second end of the pouch and when the detachable end of the single strap is fastened to the second mating component in a second configuration the single strap encircles a user's torso.

2. The security wallet of claim 1, wherein in the first configuration the fastener component is engaged with the first mating component such that the detachable end of the strap is positioned along the first end of the item holder.

3. The security wallet of claim 1, wherein in the second configuration the fastener component is engaged with the second mating component such that the detachable end of the strap is positioned along the second end of the item holder.

4. The security wallet of claim 1, wherein the at least one pocket on the front of the item holder having the closeable opening comprises a first pocket having a single gusset located on the side of the first pocket closest to the first side of the item holder and the closeable opening; and a second pocket having a single gusset on the side of the second pocket closest to the first side of the item holder and a closeable opening, the first pocket being located in front of the second pocket.

5. The security wallet of claim 4, wherein the closeable opening of the first pocket extends substantially parallel to the first and second sides of the item holder.

6. The security wallet of claim 4, wherein the closeable opening of the second pocket extends substantially parallel to the first and second ends of the item holder.

7. The security wallet of claim 4, further comprising a third pocket having a closeable opening located between the first pocket and the second pocket.

8. A security wallet comprising:

a pouch having multiple layers of fabric sewn together to form a pouch thickness and including a front layer, a back layer and at least one mid layer, the pouch including four enclosed sides that form four corners, wherein the front layer and the at least one mid layer form closeable openings that define openings for pockets and wherein the back layer is free of openings; and a single strap including a proximal end and a distal end having a fastener component, wherein the proximal end of the strap is directly attached to the pouch so that the strap extends from a first side of the pouch and the fastener on the distal end of the strap is removably coupled to one of a first mating component that extends from the first side of the pouch and a second mating component that extends from a third side of the pouch that is opposite the first side of the pouch;

wherein in a first configuration the fastener component on the distal end of the single strap is coupled to the first mating component so that the single strap is configured to hang the pouch from a neck of a user; and wherein in a second configuration the fastener component on the distal end of the single strap is coupled to the second mating component so that the single strap is configured to secure the pouch around a torso of a user.

9. The security wallet of claim 8, wherein the proximal end of the strap, the first mating component and the second mating component are each attached to an inner surface of one of the layers of material and each extend through respective first, second and third openings in the front layer of the pouch.

10. The security wallet of claim 9, wherein the first opening in the front layer of the pouch is located at the first side of the pouch and in closer proximity to a first corner of the pouch than a second corner of the pouch.

11. The security wallet of claim 10, wherein the second opening in the front layer of the pouch is located at the first side of pouch and in closer proximity to the second corner of the pouch than the first corner of the pouch.

12. The security wallet of claim 11, wherein the third opening in the front layer of the pouch is located at the third side of the pouch and in closer proximity to a fourth corner of the pouch than a third corner of the pouch, wherein the first corner of the pouch is in alignment with the fourth corner of the pouch.

13. The security wallet of claim 8, wherein the pouch further comprises a first pocket that is defined by the front layer and the at least one mid layer, the first pocket including a single gusset that defines a side of the first pocket that is closest to a second side of the pouch and a closeable opening.

14. The security wallet of claim 13, wherein the pouch further comprises a second pocket that is defined by the back layer and the at least one mid layer, the second pocket including a single gusset that defines a side of the second pocket that is closest to the second side of the pouch and a closeable opening.

15. The security wallet of claim 14, wherein the pouch further comprises a third pocket that is defined by two mid layers, the third pocket including a closeable opening.

16. A security wallet comprising:

a pouch including a front, a back and at least one pocket with a closeable opening, the at least one pocket located on the front including a gusset that runs substantially perpendicular to the closeable opening and the back of the pouch being free of pockets; and a single strap including a fixed end that is directly attached to the pouch and a detachable end that is removably coupled to the pouch, wherein the strap extends from the fixed end and outwardly from a first side of the pouch;

wherein in a first configuration the detachable end includes a fastener that detachably engages with a first fastener receiver that is coupled to the first side of the pouch and in a second configuration the fastener on the detachable end detachably engages with a second fastener receiver that is coupled to a second side of the pouch opposite the first side.

* * * * *